United States Patent [19]

Sadler et al.

[11] Patent Number: 4,709,646

[45] Date of Patent: Dec. 1, 1987

[54] FUNCTIONAL UNIT INSTALLATION IN A WARSHIP

[75] Inventors: Karl-Otto Sadler, Hamburg; Willy Schmidt, Ellerbek; Hans-Joachim Franz, Kölln-Reisiek, all of Fed. Rep. of Germany

[73] Assignee: Blohm & Voss AG, Hamburg, Fed. Rep. of Germany

[21] Appl. No.: 747,232

[22] Filed: Jun. 21, 1985

[30] Foreign Application Priority Data

Jun. 29, 1984 [DE] Fed. Rep. of Germany ..... 3424067

[51] Int. Cl.[4] ..... B63G 1/00

[52] U.S. Cl. ..... 114/5; 114/74 T; 114/261; 187/67; 267/177; 89/37.01

[58] Field of Search ..... 114/1, 5–8, 114/65 R, 74 T, 77 R, 261; 187/67; 267/166, 177; 89/37.01, 37.13, 38, 41.14, 44.01

[56] References Cited

U.S. PATENT DOCUMENTS

| | | | |
|---|---|---|---|
| 453,545 | 6/1891 | Canet | 114/6 |
| 470,036 | 3/1892 | Canet | 89/43.01 |
| 835,157 | 11/1906 | Fry | 187/67 |
| 943,498 | 12/1909 | Weller | 187/67 |
| 1,164,415 | 12/1915 | Simmons | 114/5 |
| 1,632,973 | 6/1927 | Johanknegt | 114/5 |
| 2,336,557 | 12/1943 | McCallister | 114/5 |
| 3,650,498 | 3/1972 | Deak | 267/177 |
| 3,848,558 | 11/1974 | Henry | 114/261 |
| 4,103,881 | 8/1978 | Simich | 267/177 |

FOREIGN PATENT DOCUMENTS

| | | | |
|---|---|---|---|
| 721111 | 4/1942 | Fed. Rep. of Germany | 89/37 L |
| 2056069 | 2/1979 | Fed. Rep. of Germany | 89/37 L |
| 803663 | 10/1936 | France | 89/37 L |

*Primary Examiner*—Joseph F. Peters, Jr.
*Assistant Examiner*—Clifford T. Bartz
*Attorney, Agent, or Firm*—Sughrue, Mion, Zinn, Macpeak and Seas

[57] ABSTRACT

A warship has a unit seating extending around an opening in a ship's deck with a platform mounted in the seating and levelled relative to the main scantling plane of said warship, and a functional unit installation, e.g., a weapon or a navigational apparatus, on the platform. A container carried beneath the platform, accommodates a part of the functional unit installation. Vertically resiliently acting supports carry at least a part of the weight of the platform, the container and the installation and allow limited horizontal movement of the container relative to the supports.

24 Claims, 6 Drawing Figures

19a
13
12
12
11
35
14
19b
29
29
IV
IV
16
V
26
29
29
17
27
II
II
20
20
15
20
18
III

Fig. 2
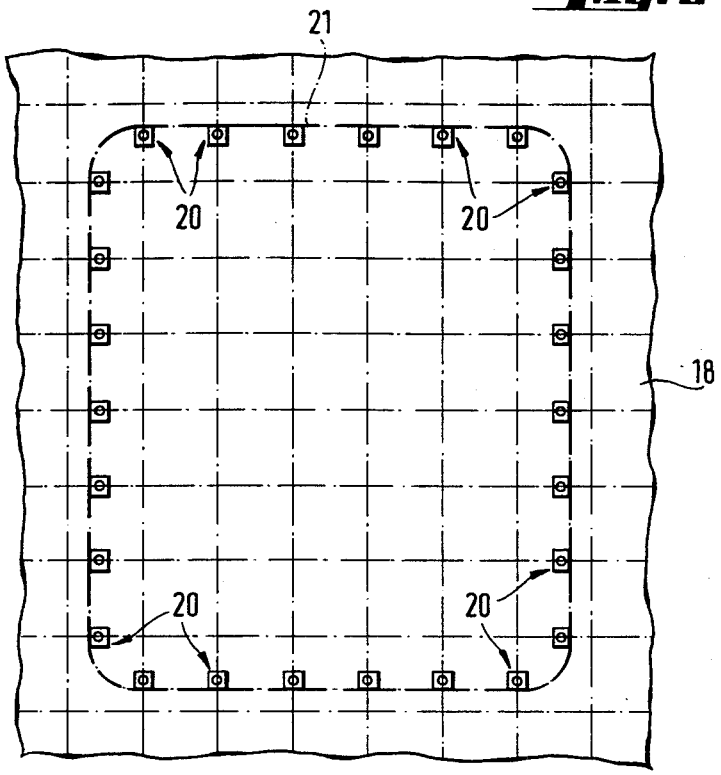
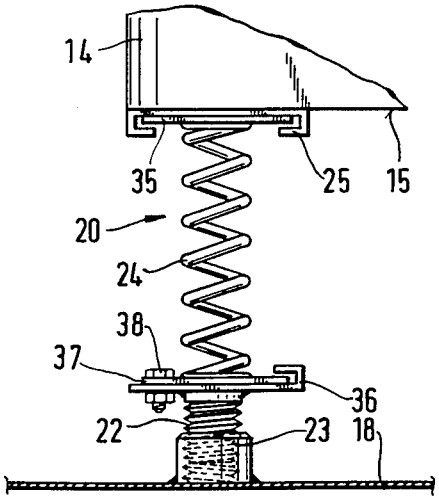
Fig. 3

FUNCTIONAL UNIT INSTALLATION IN A WARSHIP

FIELD OF THE INVENTION

The present invention relates to a warship and, more particularly, to the mounting of a functional unit installation, for example a weapon or a navigational installation, in the deck of a warship.

BACKGROUND OF THE INVENTION

In German Pat. No. 2,056,069, there is disclosed a warship having a unit mounting or seating extending around an opening in a deck of the ship, with a unit platform mounted in the seating, a functional unit installation, such as a weapon or a navigational installation, arranged on the platform and a unit container carried by the platform beneath the platform and accommodating a part of the functional unit installation, the container extending downwardly beneath the ship's deck into the interior of the ship to a lower deck located beneath the above-mentioned ship's deck.

In the warship disclosed in the aforementioned German Pat. No. 2,056,069, the lower deck, to which the unitary container substantially extends in the interior of the ship, is located directly below the uppermost deck of the ship in which the seating and the platform are located. The container is connected to the structure of the ship only through the platform and the seating i.e., only by means of a peripheraly extending securing flange. The functional unit installation may comprise a weapon or a navigational antenna arranged on the top of the platform, the devices and circuitry required for the operation of the weapon or the navigational antenna being accommodated within the container.

It is also already known to build into a ship a vertical water-tight shaft extending through a plurality of decks to the inner bottom or hull of the ship, with a corresponding multi-storey functional unit accommodated in this shaft and fixedly connected, by a suitable mounting or seating, to the hull or inner bottom of the ship. This arrangement has the disadvantage that stresses acting on the bottom of the ship, e.g. as a result of grounding or a detonation (mines, torpedos, etc.), can be transmitted to the functional unit and the latter or the apparatuses and devices contained therein can thereby become damaged. Also, even if the functional unit itself or the apparatuses and devices contained therein is or are not damaged, there is a danger that the entire functional unit may be displaced and, consequently, that an undesired alteration of the plane of the seating of the functional unit installation may occur.

Furthermore, while in the prior art warship provided with the seating as disclosed in the aformentioned German Pat. No. 2,056,069, a satisfactory levelling of the functional unit installation with respect to the ship is ensured, the seating is however, subjected to heavy loads, in particular when this functional unit installation which may extend through several decks is very heavy, in which case substantial reinforcement of the ship's deck may be required.

It is accordingly an object of the present invention to provide a novel and improved warship in which, as before, the plane of the seating of a functional unit installation arranged on a unit platform is accurately levelled with respect to the principal datum plane of the ship, while the platform and the seating bed, even when the functional unit installation has a heavy weight, are substantially relieved of loading without a risk of alteration of the plane of the seating when deformations occur in the interior of the ship.

SUMMARY OF THE INVENTION

According to the present invention, a warship comprises a unit seating extending around an opening in a ship's deck, a unit platform mounted on the seating and levelled relative to the principal datum plane of the ship, a functional unit installation arranged on the platform and a unit container carried by the platform beneath the platform and accommodating a part of the functional unit installation, the unit container extending downwardly beneath the ship's deck into the interior of the warship.

Means are provided for supporting the bottom of the unit container, the support means comprising a plurality of vertically resiliently acting supports accommodating at least a part of the weight of the platform, the unitary container and the functional unitary installation and having bearings allowing limited horizontal movement of the container relative to the support means.

Thus, according to the teachings of the present invention, at least a considerable portion of the total weight of the platform, the container and the functional unit installation mounted thereon or therein and, in some circumstances, even the total weight, can be taken up by a lower deck of the ship or the hull. The levelling of the functional unit installation relative to the ship, however, is determined as previously by the platform mounted on the seating in the above-described manner. This is made possible since the support means, which take up substantially only vertically acting weight forces, allow free horizontal movement of the lower portion of the container. By the provision of the vertically resiliently acting supports it is furthermore ensured that deformations of the lower deck, e.g. by grounding or detonations in the submarine vicinity, can not damage the functional unit installation and can not affect the levelling of the plane of the seating.

Furthermore, the construction of the ship in accordance with the present invention ensures that the relative movements which occur at sea between the uppermost deck and the lower deck or the hull, at which the container is additionally supported, have no effect on the supporting of the platform on the seating.

Preferably, the support means are provided between the bottom of the unitary container and the lower deck or hull of the ship. Also, the supports may be distributed around a peripheral edge portion of the container. In this way, the levelling of the support means relative to the main scantling plane of the ship before the installation of the container is facilitated.

Preferably, the support means include means for effecting vertical adjustment thereof, in which case the vertical adjustment means may comprise a plurality of nuts and vertical shafts in relatively adjustable threaded engagement with respective ones of the nuts. In this way the relieving or support force exerted on the container by the support means can be accurately adjusted. Furthermore, a torque wrench can for example be employed by means of which the desired relieving force can be adjusted without requiring particular care by the personnel effecting the vertical adjustment.

To provide the vertical resilience, the support means may comprise a plurality of vertically acting spring arrangements. Preferably, the spring arrangements have a spring characteristic such that relative movement between the lower deck or hull of the ship and the bottom of the unitary container in the vertical direction is possible for compensating deformation of the lower deck occurring upon grounding of the ship or upon an explosion, without an increase or decrease, sufficient to impair the functional unit, of the support force exerted on the functional unit installation by the spring arrangements.

Sufficient protection against damage by deformation of the lower deck is achieved if the relative movement made possible by the spring characteristic is 5 to 20 cms, preferably 5 to 15 cms and, optimally about 10 cms. Further, the spring characteristic is preferably such that, within the range of the relative movement, the support force is raised or lowered by no more than 50%, preferably 30% and, optimally, approximately 20%.

In order to allow substantial unhindered movement of the bottom of the container in the horizontal direction, a horizontal slide bearing is preferably provided between the bottom of the unitary container and the supporting lower deck or hull. To this end, the support means may comprise bearing means secured to the bottom of the container for allowing the horizontal movement of the container.

The invention is of particular importance when the container extends to the lower deck through openings, formed with a shape corresponding to the cross-sectional shape of the container, in intermediate decks provided between the ships deck and the lower deck. Such containers are particularly heavy due to their large diversions in the vertical direction. Furthermore, the lever arm exerted by such containers on the seating is relatively long.

For providing a multi-deck container, no shaft extending between the individual intermediate deck openings is provided, but instead the container is supported only by the seating and by the support means which are provided at the bottom. In order, however, in this case to also provide a satisfactory water-seal between the individual decks and the container, a peripheral seal may be provided between the container and the or each intermediate deck.

Since relatively high multi-deck containers, during movements at sea, exert relatively large tilting moments on the seatings in the uppermost ships deck, a particularly advantageous embodiment of the inventions provides that the container is supported horizontally, at at least one of the openings, relative to the associated intermediate deck. While the support means provided at the bottom of the container should, of course, make up no horizontal forces, the horizontal forces are absorbed by the intermediate decks through which the container extends. In this case, the peripheral seal advantageously also fulfills the function of providing horizontal support.

For adjusting the magnitude of the horizontal forces, a preferred embodiment of the invention provides that adjustable means extending round the opening in the or each intermediate deck are provided for horizontally spacing apart the container and the intermediate deck. In this case, the horizontal spacer means preferably comprise a pair of peripheral sealing sleeves bearing against the container and the intermediate deck, respectively.

A very sensitive adjustment of the horizontal supporting force can be ensured if the horizontal spacer means comprise a pair of horizontally spaced apart, relatively adjustable spreader or clamp members and adjustable means for varying the horizontal spacing of the spreader members.

In this case, upper and lower horizontal sealing strips are preferably provided, together with means for clamping the sealing strips vertically against the spreader members, the clamping means including a clamping plate and a horizontally extending flange fixed to the intermediate deck.

If it is required to mount in a particular seating, intended for receiving a multi-deck container, a container of somewhat lesser height, then the support means may be provided on a support cover secured to an intermediate or lower deck and closing an opening in the latter.

The present invention also includes the mounting of containers, carrying functional unit installations, in openings which are advantageously rectangular or quadratic and which are arranged vertically with one beneath the other in a plurality of decks. Preferably, the platform connected to the container carries installations, e.g. a weapon or a navigational antenna, projecting above the ship's deck. Beneath the uppermost ship's deck, there are provided apparatuses and devices for installation within the interior of the container, together with the supply connections required therefor. The container is fixedly connected in a water-tight manner to the upper deck of the ship by a securing flange formed by the platform and extending around the container. A pressure flange extending around the container is provided for a water-tight, resilient sealing to each deck penetrated by the container, this pressure flange also being suitable for taking up the horizontal forces caused by the movement of the ship. At predetermined pressure points at the bottom of the unitary container, predetermined portions of the weight are transferred by the support means to the lower deck, a predetermined portion of vertical forces caused by the ship's movement and by any shock load which may occur also being taken up. Sealing strips in all of the decks through which the container extends are so constructed that they can follow alterations in the position of the functional unit for levelling the plane of the seating. By the pressure of rubber strips, the water sealing is provided and the horizontal forces which occur are transferred, without further measures, from the functional unit installation to the deck structure. The support means arranged beneath the functionally unit installation on the interior of the bottom or the lower deck of the ship for taking up the weight are adjustable in height for adjustment purposes. Due to the height adjustability, the load taken up by each support can be exactly predetermined. It is important that the horizontal movements of the lower deck, resulting from deformation of the structure of the ship, are not transferred by the supports to the container.

Future weapon developments will involve, primarily, long range rockets of considerable length, which are launched vertically from a correspondingly arranged container. Furthermore, large caliber weapons with varying ammunition and employing final stage guidance will be frequently employed. These future weapons installations require functional unit installations which extend through the height of several decks and which, due to the ammunition contained therein, can have a very high weight.

The present invention offers the advantage that the large weights which exist with functional unit installations of very heavy weight need no longer be supported by the upper ship's deck so that the structure of that deck can be economically built.

Due to the relative movement between the upper deck and the inner bottom or lower deck, which are caused by the deformation of the structure of the ship at sea, the support means may be provided with horizontally acting slide bearings. In order, nevertheless, to ensure satisfactory horizontal support of the container, the container may be additionally horizontally supported in one of the overlying decks in order that the securement thereof in the uppermost ship's deck is not excessively stressed.

The preferred embodiment of the present invention thus comprises a ship in which the top of the container, independent of the installation provided on it, is the platform having a securement flange of the same dimensions, which can be releasably secured by means of the securement flange and the seating fixed relative to the ship, to the ship's structure and which can be levelled relative to the main scantling plane.

At the height of each deck penetrated by the container, pressure flanges are provided which, by their dimensions and tolerances, are capable of absorbing all horizontal forces which occur and also which have a compressed rubber member to provide the required water-seal. The edge of the opening provided in the deck penetrated by the container is so constructed that it can receive correspondingly adjustable sealing strips, which can follow variations in the position of the container during the levelling of the mounting or seating plane, can provide the water seal by compression of rubber strips and can transfer the horizontal forces which occur from the functional unit to the deck structure.

At the bottom of the container, the supports are peripherally spaced so that by their arrangement, they can take up a predetermined portion of the vertical loads which occur and can also allow the horizontal movements caused by the deformation of the structure of the ship. At the interior bottom of the ship, beneath the container, the supports form a peripheral mounting which comprises, beneath each pressure point provided at the bottom of the container, a height adjustable receiving device which is dimensioned in accordance with the weight to be supported. By adjustment of the heights of these devices, the load taken up by each support can be exactly predetermined, so that the distribution of the load between the upper securement flange and the underlying deck or hull can be determined in accordance with the prevailing situation. Shock dampers may be utilized as the supports for the purpose of the present invention.

Also, when the load is fully supported, the supports or shock dampers should have available a free spring path of about 100 mm, in order to be able to compensate any deformations of the bottom of the ship, which can be caused by grounding or by a detonation, without damage occuring to the functional unit installation.

BRIEF DESCRIPTION OF THE DRAWINGS

The invention will be more readily understood from the following description of the preferred embodiments thereof given by way of example, with reference to the accompanying drawings, in which:

FIG. 2 shows a diagramatic view taken in section along the line II—II of FIG. 1 for illustrating the mounting of a container on a lower deck;

FIG. 3 shows in an enlarged scale the portion III of FIG. 1;

DESCRIPTION OF THE PREFERRED EMBODIMENTS

Figure 1:
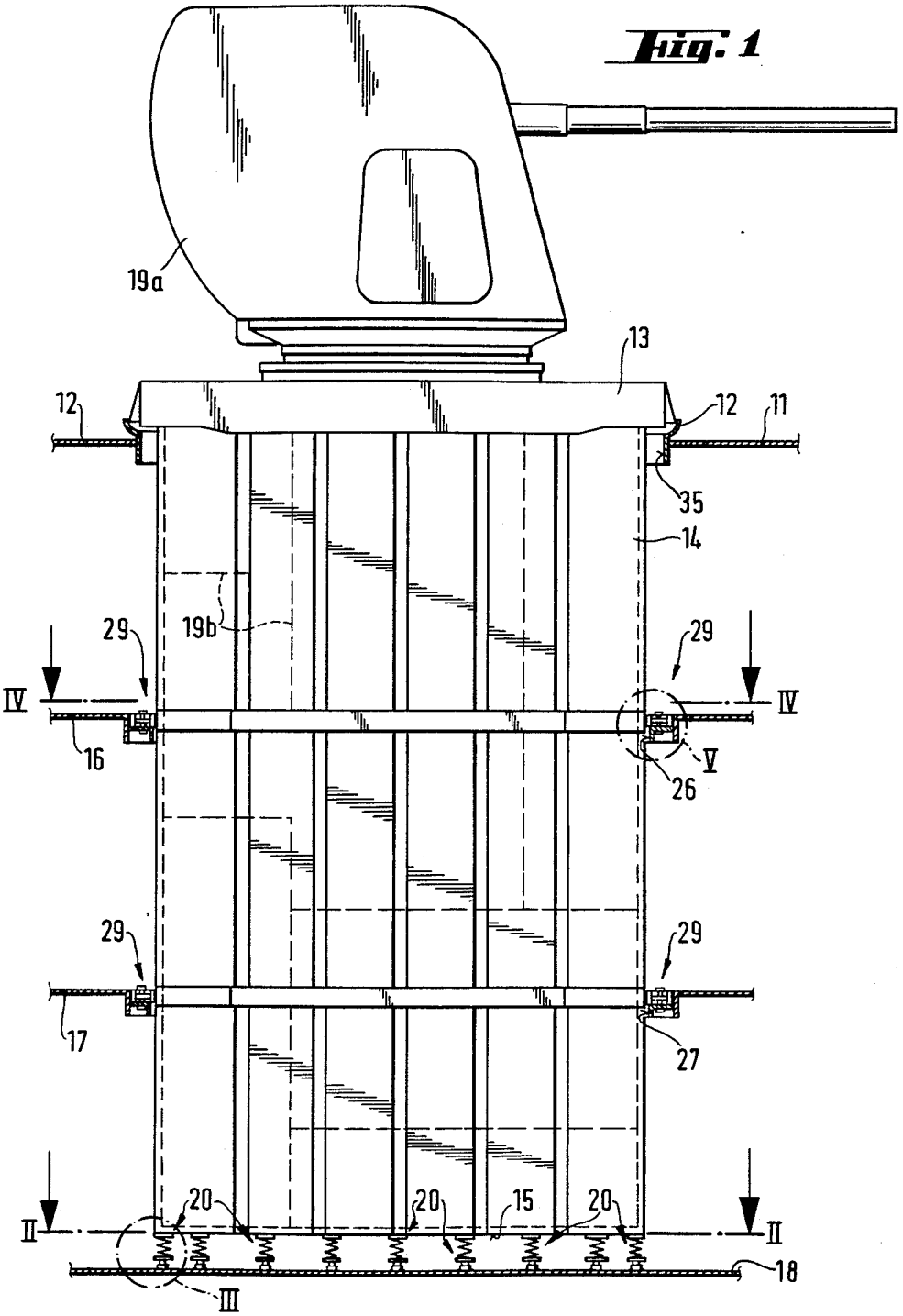
FIG. 1 shows a diagramatic side elevation, partly broken away in section, of a functional unit installation in a warship embodying the present invention.

Referring firstly to FIG. 1, the weather deck or uppermost ship's deck 11 of a warship embodying the present invention is provided with an installation opening 35 of quadratic or rectangular cross-section, around which extends a unit seating or mounting 12. On the seating 12 there is fixed a unit platform 13, which is levelled relative to the main scantling plane of the ship as described in detail in German Pat. No. 2,056,069.

At its underside, a quadratic unit container 14 is secured to the platform 13 and, together with platform 13, carries a functional unit installation, which comprises a weapon **19*a* arranged on the platform 13 and associated apparatuses and devices 19*b* which are provided in the container 14**.

The container 14 extends, through openings 26, 27 of quadratic or rectangular shape corresponding to that of the cross-section of the container 14 and provided in intermediate decks 16 and 17 located beneath the ship's deck 11, almost to a lower deck 18, which can for example be formed by the interior bottom or hull of the ship. The vertical spacing of the individual decks 11, 16, 17 and 18 is normally 2.5 meters.

The bottom 15 of the container 14, which is spaced from the lower deck 18, is supported on the lower deck 18 by supports 20 which, as shown in FIG. 2, are arranged at a uniform spacing around the periphery 21 of the unit container 14.

Each support 20 comprises, as shown in FIG. 3, a nut 23 which is fixed to the lower deck 18 and into which is threaded a vertically extending shaft 22. At its upper-end, the shaft 22 has a bearing 36, to which a lower counter-bearing 37 of a spring arrangement 24 is secured, e.g. by means of a screw 38.

The spring arrangement 24, which can be constructed as a shock absorber, extends vertically to an upper counter-bearing 39, which is held by a bearing 25 fixed to the underside of the bottom of the unit container 14 in such a manner that a limited horizontal movement is possible between the counter-bearing 39 and the bearing 25.

Figure 4:
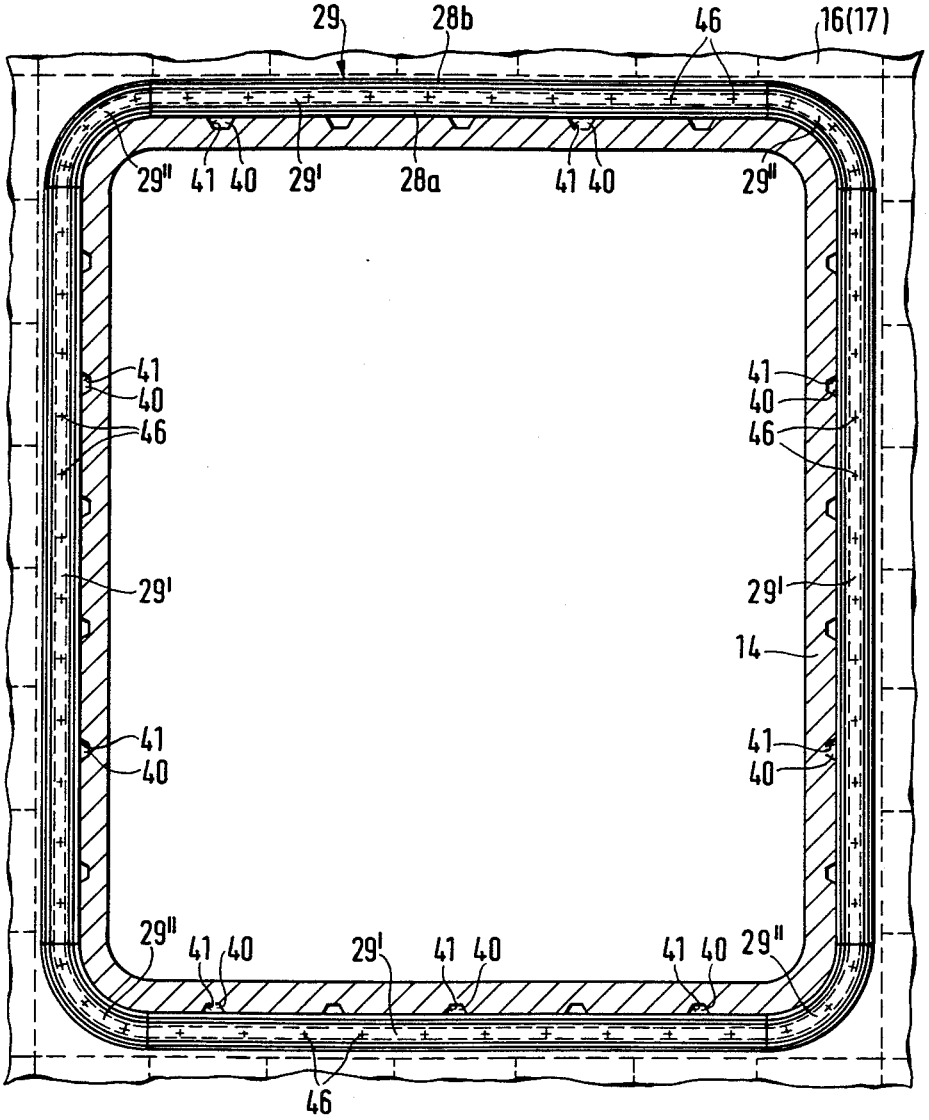
FIG. 4 shows a diagramatic view taken in section along the line IV—IV of FIG. 1.
Figure 5:
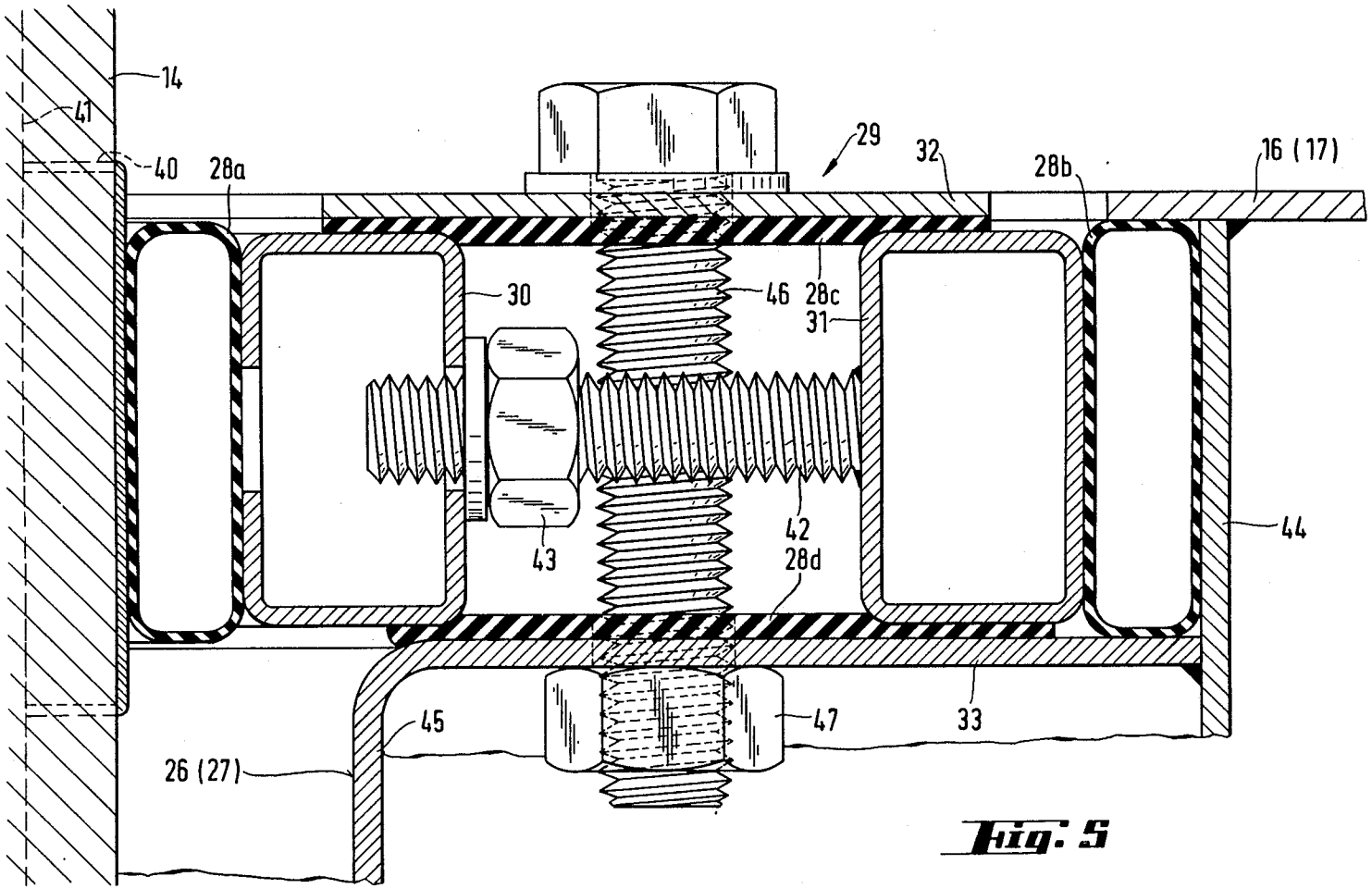
FIG. 5 shows in an enlarged scale the portion V of FIG. 1.

As shown in FIGS. 1, 4 and 5, between the edges of the through openings 26, 27 and the container 14, spreader devices 29 are provided, which serve both to provide water seals between the decks and also to support the container 14 horizontally relative to the intermediate decks 16, 17.

As shown in FIGS. 4 and 5, the spreader device has a peripheral sealing sleeve **28*a* which extends around the unit container 14 at the height of each intermediate deck 16, 17, and which lies partly between the outerwall of the container 14 and a clamping or spreader member 30 forming part of the spreader device 29**. As shown in FIG. 4, sealing filler pieces 40 are inserted at the heights of the intermediate decks into vertical grooves 41 formed in the outer wall of the container 14, the peripheral sealing sleeve 28*a* abutting against the filler pieces 40 in the vicinity of the vertical grooves 41. The arrangement of the vertical grooves 41 and the filler pieces 40 is shown in broken lines in FIG. 5.

The inner clamping member 30 is supported relative to outer clamping members 31, by bolts, of which only one is shown and indicated by reference numeral 42 and each of which is provided with a nut 43 for adjusting the spacing between the clamping or spreader members 30, 31.

Beneath each of the intermediate decks 16 and 17, around the respective through opening 26 or 27, there is provided a vertical wall portion 44, from which an inwardly projecting horizontal flange 33 extends at a spacing beneath the intermediate deck 16 or 17, the flange 33 having, adjacent the container 14, a downwardly extending bent portion 45. The clamping members 30, 31 are located at a small spacing above the flange 33 and are separated therefrom by a peripheral sealing strip 28*d*.

Parallel to the flange 33, and above the clamping members 30, 31, there is provided a clamping plate 32 which, like the flange 33, overlaps the two clamping members 30, 31. Between the clamping plate 32 and the clamping members 30, 31 there is provided a further peripheral sealing strip 28*c* which also overlaps the clamping members 30, 31.

In the intermediate space between the outer clamping member 31 and the vertical wall portion 44, there is provided a further peripheral sealing sleeve 28*b*.

In FIGS. 2 and 4 a deck structure reinforcing the individual decks 16, 17 and 18 is indicated by broken lines.

As shown in FIG. 4 the spreader device 29 comprises straight pieces 29′ extending along the side walls of the unit container 14 and curved pieces 29″, connecting the straight pieces 29′ at the corners.

The installation of the container 14 in the warship is effected as follows:

Firstly, the supports 20, comprising vertical adjustment pieces 22, 23 and shock dampers 24 arranged in series therewith, are levelled as well as possible relative to the main scantling plane of the ship on the lower deck or the inner bottom 18 of the ship, as shown in FIGS. 1 and 2. Subsequently, the container 14, provided with the weapon 19*a* and the built-in apparatuses and devices 19*b*, i.e., the functional unit installation, is mounted by means of the platform 13 on the spreader 12 whereby the container 14 is passed through the through openings 26, 27 in the intermediate decks 16, 17. The container 14 is then partially supported by the supports 20. The levelling of the platform 13 relative to the ship is then effected, as taught in German Pat. No. 2,056,069, the container 14 being able to carry out the required tilting movements relative to the structure of the ship and the decks, 11, 16, 17 and 18 without further measures since the spreader devices 29 have not yet been fitted and horizontal displacement of the bottom 15 relative to the vertical supports 20 is possible. After the platform 13 has been properly levelled, it is fixed by means of plastics material to the seating 12.

The shafts 22 (FIG. 3) are then rotated from the nuts 23 by means of a torque wrench until the shock absorbers or spring arrangements 24 have exerted predetermined forces on the underside of the bottom 15 of the container 14. After this procedure has been carried out at each of the supports 20, the latter support a predetermined portion of the weight of the unit container 14. The seating 12 and the platform 13 are therefore correspondingly relieved of loading.

The curved portions 29″″ of the spreader devices 29 are then firstly inserted into the intermediate spaces between the decks 16 and 17, on one hand, and the unit container 14, on the other hand, and are spread apart by adjustment of the nuts 43 (FIG. 5) on the bolts 42 until the peripheral sealing sleeves 28*a*, 28*b* between the unit container 14 and the clamping member 30 and between the clamping member 31 and the vertical wall portion 44 are tightly clamped. During this tightening operation, the vertical bolt 46 connecting the clamping plate 32 with the flange 33 is still loose so that relative displacement of the clamping members 30, 31 in the radial direction is not hindered.

When the spreader device has been located and adjusted in the vicinity of each of the four curved portions 29″, the straight pieces 29′ are firstly cut to suit the spacings exisiting between the individual curved portions 29″. The straight pieces 29′ of the spreader device 29 are then arranged between the curved portions 29″ and, like the curved portions 29″, are spread apart by the adjustment of the nuts 43 so that the horizontal forces required for properly holding the container 14 can be transferred from the decks 16 and 17 to the container 14 and vice versa.

The lower peripheral sealing strip 28*d* must be fitted before the spreader device 29 is arranged on the flange 33.

After the required tightening between the decks 16, 17 and the container 14 has been effected, the upper-peripheral sealing strip 29*c* is placed on the clamping members 30, 31. The correspondingly shaped clamping plate 32 is subsequently now placed in position and the vertical bolts 36 are inserted through the clamping plate 32 and the flange 33 at openings which are bored at positions provided at appropriate spacing. By means of nut 47, the bolt 46 is tightened so that the clamping plate 32 presses the sealing strips 28*c* and 28*d* against the clamping members 30, 31 from above and from below.

At this time, not only is the required horizontal support of the container 14 by the intermediate decks 16, 17 effected, but also a proper water seal is produced between the spaces lying above and below the intermediate decks 16, 17.

If the vertical grooves 41 (FIGS. 4, 5) are provided in the outer wall of the container 14, the filler pieces 40 must be inserted therein before the fitting of the spreader device 29.

To allow the shaft 22 to be rotated upwardly, rotary movement between the shaft 22 and the lower counterbearing 37 of the spring arrangement 27 must be possible. After the shaft 22 has been rotated in the required manner from the nut 23, the counterbearing 37 is fixedly connected by one or more bolts 38 to the bearing 37 fixed to the shaft 22.

In FIG. 9, the same reference numerals have been employed to indicate corresponding parts as in the preceding figures.

Figure 6:
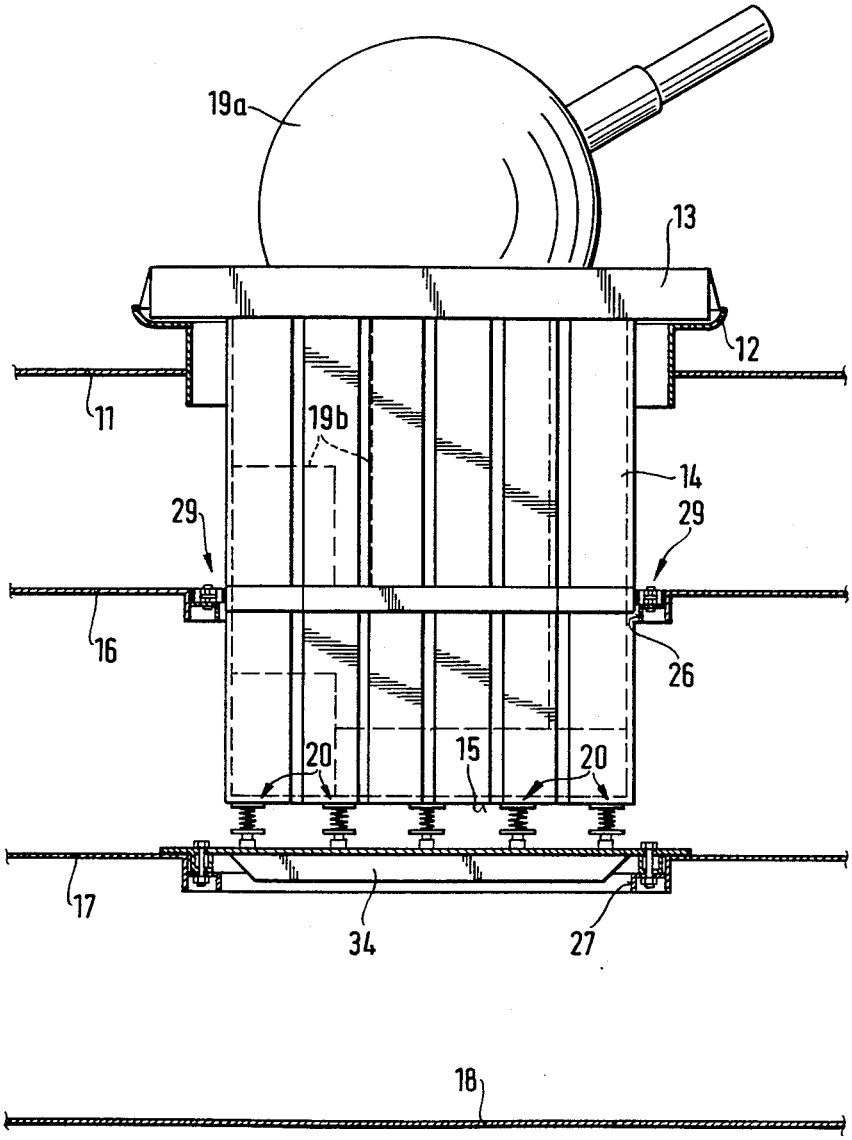
FIG. 6 shows a digramatic view in section, and analogous to FIG. 1, illustrating however the mounting in the warship of a container of reduced height at a spacing from the lower most deck.

As shown in FIG. 6, the container 14 has a height which is smaller, by the spacing of the decks 17, 18, than in the embodiment of FIG. 1. In order to make it possible to secure the container 14 in this case, the through opening 27 in the intermediate deck 17 is securely closed by a cover 34, which carries the supports 20 on its upper side and which is so strongly constructed that, analogous to the inner bottom 18 in the embodiment of FIG. 1, it can transfer the required relieving forces through the supports 20 to the container 14. Since in the embodiment of FIG. 6 the container 14 extends only through the through opening 26 in the intermediate deck 16, a spreader device 29 is only provided at the intermediate deck 26, and this spreader device is constructed and operates just as described hereinabove with references to FIGS. 4 and 5. The supports 20 are arranged between the bottom 15 of the container 14 and the support cover 34 and operate in the manner described hereinabove with reference to FIGS. 1 to 3.

The invention is, therefore, particularly suitable for a container having a height equal to at least two deck heights, i.e., a container which is connected at its top to the platform, and then is supported and sealed by an opening in at least one underlying deck, and, finally, is additionally supported at its underside by a lower deck.

I claim:

1. A warship comprising:

a unit seating extending around an opening in a ship's deck, a unit platform mounted in said seating and levelled relative to the said warship;

a functional unit installation mounted on and extending downwardly through said platform;

a unit container carried by said platform, beneath said platform, said unit container accommodating a part of said functional unit installation and extending downwardly beneath the ship's deck into the interior of the warship; and spring means for supporting the bottom of said unit container;

said spring means comprising vertically resiliently acting means for supporting at least a part of the weight of said platform, said unit container and said functional unit installation; and means underlying said spring means for supporting said spring means;

said spring means being horizontally deflectable to allow relative horizontal movement of said unit container and said support means in response to damage to said warship.

2. A warship as claimed in claim 1, wherein said means underlying said spring means comprise a lower deck of said ship.

3. A warship as claimed in claim 1, wherein said spring means comprises a plurality of supports distributed around a peripheral edge portion of said container.

4. A warship as claimed in claim 1, wherein said spring means include means for effecting vertical adjustment thereof for varying the weight supported by said spring means.

5. A warship as claimed in claim 4, wherein said vertical adjustment means comprises a plurality of nuts and vertical shafts in rotatably adjustable threaded engagement with respective ones of said nuts for varying the weight supported by said spring means.

6. A warship as claimed in claim 1, wherein said spring means comprises a plurality of vertically acting spring arrangements for exerting a vertical support force on said container.

7. A warship as claimed in claim 6, wherein said spring arrangements are provided on a lower deck and have a spring characteristic such that relative movement between said lower deck and the bottom of said unitary container in the vertical direction is possible for compensating deformation of said lower deck, occurring upon grounding of said ship or upon an explosion, without increasing or decreasing, by an amount sufficient to impair said functional unit installation, a support force exerted on said functional unit installation by said spring arrangements.

8. A warship as claimed in claim 7, wherein said relative movement made possible by said spring characteristic is 5 to 20 cms.

9. A warship as claimed in claim 7, wherein said relative movement made possible by said spring characteristic is 5 to 15 cms.

10. A warship as claimed in claim 7, wherein said relative movement made possible by said spring characteristic is approximately 10 cms.

11. A warship as claimed in claim 8, wherein said spring characteristic is such that, within the range of the relative movement, said support force is raised or lowered by no more than 50%.

12. A warship as claimed in claim 8, wherein said spring characteristic is such that, within the range of the relative movement, said support force is raised or lowered by no more than 30%.

13. A warship as claimed in claim 8, wherein said spring characteristic is such that, within the range of the relative movement, said support force is raised or lowered by no more than 20%.

14. A warship as claimed in claim 1, wherein said spring means comprise means secured to the bottom of said container for allowing limited horizontal movement of said container bottom.

15. A warship as claimed in claim 1, wherein said container extends through a further opening which is formed in at least one intermediate deck located between said ship's deck and the hull of said ship and which has a shape corresponding to the cross-sectional shape of said container.

16. A warship as claimed in claim 15, further comprising means providing a peripheral seal between said container and said intermediate deck.

17. A warship as claimed in claim 15, further comprising means for horizontally supporting said container relative to said intermediate deck.

18. A warship as claimed in claim 17, wherein said horizontal support means comprises means for providing a peripheral seal between said container and said intermediate deck.

19. A warship as claimed in claim 16, further comprising adjustable means extending around said further opening for horizontally spacing apart said container and said intermediate deck.

20. A warship as claimed in claim 19, wherein said horizontal spacing means comprises a pair of peripheral sealing sleeves bearing against said container and said intermediate deck, respectively.

21. A warship as claimed in claim 20, wherein said horizontal spacing means comprises a pair of horizontally spaced apart, relatively adjustable spreader member located between said sealing sleeves and adjustable means for varying the horizontal spacing of said spreader members.

22. A warship as claimed in claim 21, further comprising upper and lower horizontal peripheral sealing strips, and means for clamping said sealing strips vertically against said spreader members, said clamping means including a clamping plates and a horizontally extending flange fixed to said intermediate deck.

23. A warship as claimed in claim 1, wherein said spring means are provided on a support cover secured to an intermediate or lower deck and closing an opening in the latter.

24. A warship as claimed in claim 1, wherein said spring means comprise a plurality of springs and a plurality of height adjustment devices arranged in series with said springs.

* * * * *